US012016419B2

(12) United States Patent
Paulson

(10) Patent No.: US 12,016,419 B2
(45) Date of Patent: Jun. 25, 2024

(54) WEIGHT COMPENSATING BRACKET

(71) Applicant: PAULSON MANUFACTURING CORPORATION, Temecula, CA (US)

(72) Inventor: Roy Paulson, Murietta, CA (US)

(73) Assignee: Paulson Manufacturing Corporation, Temecula, CA (US)

( * ) Notice: Subject to any disclaimer, the term of this patent is extended or adjusted under 35 U.S.C. 154(b) by 119 days.

(21) Appl. No.: 17/703,817

(22) Filed: Mar. 24, 2022

(65) Prior Publication Data

US 2023/0301388 A1 Sep. 28, 2023

(51) Int. Cl.
*A42B 3/20* (2006.01)
*A42B 3/22* (2006.01)

(52) U.S. Cl.
CPC ..... *A42B 3/20* (2013.01); *A42B 3/221* (2013.01); *A42B 3/222* (2013.01); *A42B 3/223* (2013.01)

(58) Field of Classification Search
CPC ..... A42B 3/20; A42B 3/221; A42B 3/222; A42B 3/223; A42B 3/225
See application file for complete search history.

(56) References Cited

U.S. PATENT DOCUMENTS 4,442,551 A * 4/1984 Hellberg ..... A42B 3/04 2/10
4,479,738 A * 10/1984 Kubnick ..... A61F 9/06 2/10
4,796,308 A * 1/1989 Bourgeois ..... A42B 3/185 24/301
6,041,435 A * 3/2000 Paulson ..... A42B 3/225 2/10
6,807,679 B1 * 10/2004 Wang-Lee ..... A42B 3/04 16/334
8,214,920 B1 * 7/2012 Edgar ..... A42B 3/04 2/8.2
9,516,911 B2 * 12/2016 Happel ..... A42B 3/225
10,136,693 B1 * 11/2018 Paulson ..... A42B 3/223
10,165,819 B2 * 1/2019 Klotz ..... A42B 3/04
11,160,323 B2 * 11/2021 Sanders ..... A42B 1/0188
11,612,204 B2 * 3/2023 Maltz ..... A44B 13/00 2/422
2004/0181856 A1 * 9/2004 Oleson ..... A42B 3/04 2/10
2004/0199982 A1 * 10/2004 Wang-Lee ..... A42B 3/225 2/10
2009/0313745 A1 * 12/2009 Kang ..... A42B 3/225 2/424
2012/0246807 A1 * 10/2012 Klotz ..... A42B 3/225 2/243.1
2012/0291173 A1 * 11/2012 Gleason ..... A42B 3/225 2/10
2015/0040299 A1 * 2/2015 Guay ..... A42B 3/222 2/422

(Continued)

*Primary Examiner* — Khaled Annis
(74) *Attorney, Agent, or Firm* — JAQUEZ LAND GREENHAUS & McFARLAND LLP; Bruce W. Greenhaus, Esq.

(57) ABSTRACT

A weight compensating bracket to releasably and pivotably mount a protective face shield to a helmet. The bracket has an adapter, which places the pivot of the cap bracket to which the face shield is mounted, rearwardly from the releasable connector to the helmet, enabling the face shield to be well balanced when in the stowed position above the helmet.

14 Claims, 11 Drawing Sheets

(56) References Cited

U.S. PATENT DOCUMENTS

| | | | | |
|---|---|---|---|---|
| 2015/0143618 | A1* | 5/2015 | Pereira | A42B 3/04 24/3.12 |
| 2015/0143669 | A1* | 5/2015 | Pereira | A42B 1/24 24/3.12 |
| 2015/0264992 | A1* | 9/2015 | Happel | A42B 3/04 2/422 |
| 2020/0383417 | A1* | 12/2020 | Bohn | A42B 3/225 |
| 2022/0047030 | A1* | 2/2022 | Summersett | A42B 3/22 |
| 2022/0361620 | A1* | 11/2022 | Lu | A42B 3/221 |
| 2023/0232931 | A1* | 7/2023 | Lu | A42B 3/225 2/195.1 |
| 2023/0301388 | A1* | 9/2023 | Paulson | A42B 3/20 2/424 |

* cited by examiner

WEIGHT COMPENSATING BRACKET

FIELD OF THE INVENTION

This structure relates generally to protective face shields and, more particularly, to a bracket for mounting a face shield to a helmet to enable easy transition of the face shield from the deployed position to the stowed and balanced position, and convenient replacement of the face shield.

BACKGROUND OF THE INVENTION

Face shields are employed in many human endeavors, such as electrical workers, operators of machinery, and the like.

Some kind of hinge or pivot mechanism is employed to couple the bracket, to which the face shield is mounted, to a helmet, to enable the face shield to be moved from the deployed position to the stowed position, and vice versa. The deployed position is when the protective face shield is in front of the user's face in a protective position. The stowed position is when the face shield is rotated upward, approximately 90°, so it is away from the user's face and is generally above the helmet. The hinge mechanism provides for movement between the two positive positions, and rotation between those positions to enable the worker to easily move the face shield between those two positions.

Some hinge mechanisms are relatively complex as it seeks to move the face shield to a somewhat balanced stowed position.

Some relatively simple hinge mechanisms provide a rotation of the face shield without regard to balancing the face shield over the user's head when in the stowed position. Such a common mechanism is shown in FIG. 3 herein, where the face shield, when in the in the stowed position, can extend forward as much as 8 inches, or more, from the helmet brim. An example of an apparatus which addresses the effort to achieve a balanced stowed position involves a sliding mechanism which can be hindered in its pivoting motions by sand and debris. Some face shield pivoting mechanisms may even fail to properly operate in sandy environments. In cold environments, the breath of the user can result in ice buildup, which can lock up a sliding pivot mechanism, preventing the face shield from achieving the final deployed or stowed position. Some prior art hinge mechanisms require multiple steps to raise or lower the face shield. Also, some prior art bracket mechanisms make it very difficult to remove the cap bracket and the face shield from the helmet.

SUMMARY OF EMBODIMENTS OF THE INVENTION

The invention embodiments described herein provide a face shield and cap bracket which are easily connected to and disconnected from a helmet, while at the same time enabling the face shield in stowed position to reside over the helmet in a generally balanced manner rather than simply pivoting the face shield upward, which would leave a majority of the face shield projecting forward of the helmet.

An adapter provides the structure for removably connecting the weight compensating bracket to the helmet. The face shield is mounted to the cap bracket which is pivotably mounted to the weight compensating bracket.

A clever arrangement of the pivot point location enables the face shield, when moved to the stowed position, to reside above the helmet while minimally projecting forward of the helmet. In the stowed position the face shield is balanced above the user's helmet. By "balanced" is meant that the face shield does not project forwardly or rearwardly with respect to the helmet in an unbalanced position. "Balanced" is not intended to mean that the face shield is perfectly positioned above the helmet, with exactly 50% of its weight being forward and 50% being rearward of its center of gravity as pivoted to the stowed position above the helmet.

A purpose of the weight compensating bracket is to enable the face shield to be easily moved between the two stable positions by the user, in addition to the long-term comfort experienced by the user due to the face shield being balanced when in the stowed position. It has been observed that workers perform their jobs with the face shield in the stowed position a majority of the time. The face shield is in the deployed position only when the work situation makes it necessary. Further, the simple, single pivot mechanism of the present bracket structure is not hindered in its movement between deployed and stowed positions by dirt, sand, or ice buildup during use. Since there is no sliding mechanism involved in this pivot, there is nothing to bind due to conditions in the work area that could lead to it being subject to dirt, sand, or ice.

Because of the present bracket and pivot mechanism, the face shield can easily and positively be moved from the deployed to the stowed position. Similarly, from the stowed position, only a simple nod of the user's head is sufficient to move the face shield to the deployed position.

As contemplated, the present pivot mechanism has no springs or metal parts, and no lubrication is required. It is preferably made from dielectric parts. Further, it has no exterior mechanism or projections that could cause a catching or interference hazard when the user is working in a confined space. More particularly, when in the stowed position the face shield also does not project way out front, which position could result in interference in the work area.

Another purpose of the bracket of this concept is to enable the face shield to be easily attached and detached from the helmet. A pawl in the adapter is configured to secure the cap bracket to the helmet. The pawl has a curved tip which can be released from the helmet by depressing it to disengage it from the helmet slot.

BRIEF DESCRIPTION OF THE DRAWING

The purposes, features, and advantages of the disclosed structure will be more readily perceived from the following detailed description, when read in conjunction with the accompanying drawing, wherein.

DETAILED DESCRIPTION OF THE PREFERRED EMBODIMENTS

Figure 1:
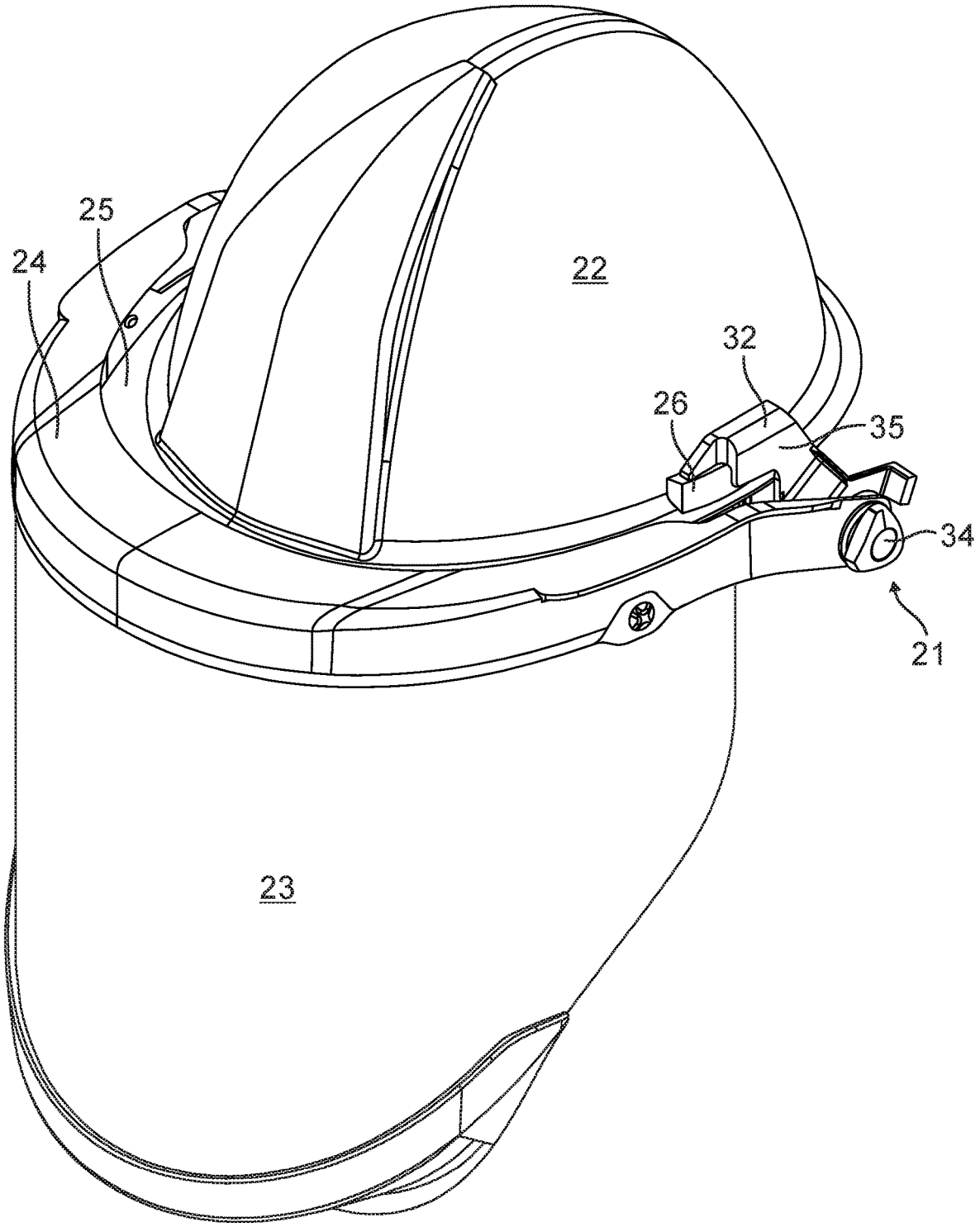
FIG. 1 is a perspective view of an embodiment of the invention, shown with a helmet and a protective face shield, the face shield being in the deployed position.
Figure 2:
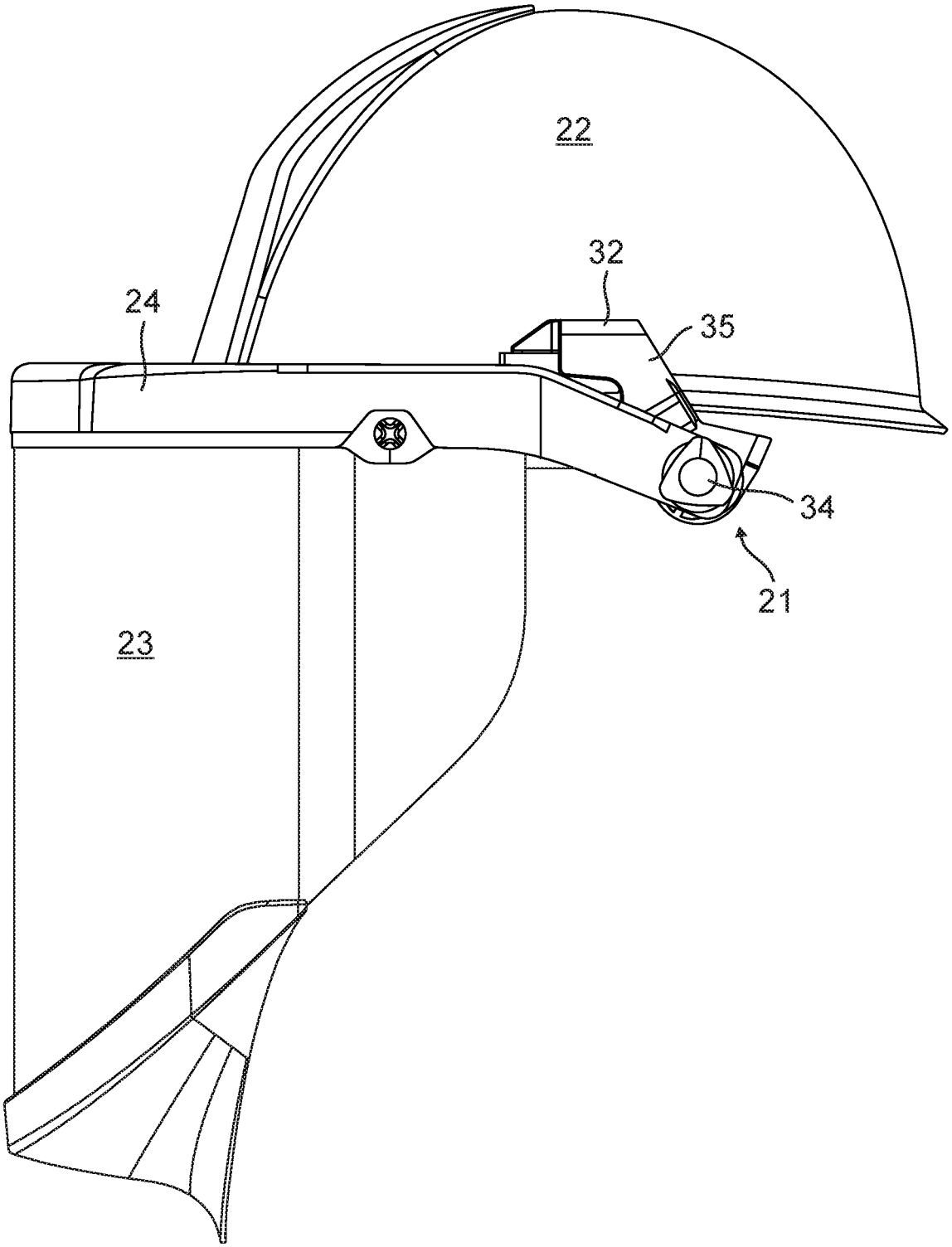
FIG. 2 is a side view of the structure shown in FIG. 1.

With reference now to the drawing, and more particularly to FIGS. 1 and 2, there is shown weight compensating bracket 21 which removably couples cap bracket 24 to helmet 22. Protective face shield 23 is mounted to the cap bracket.

Figure 8:
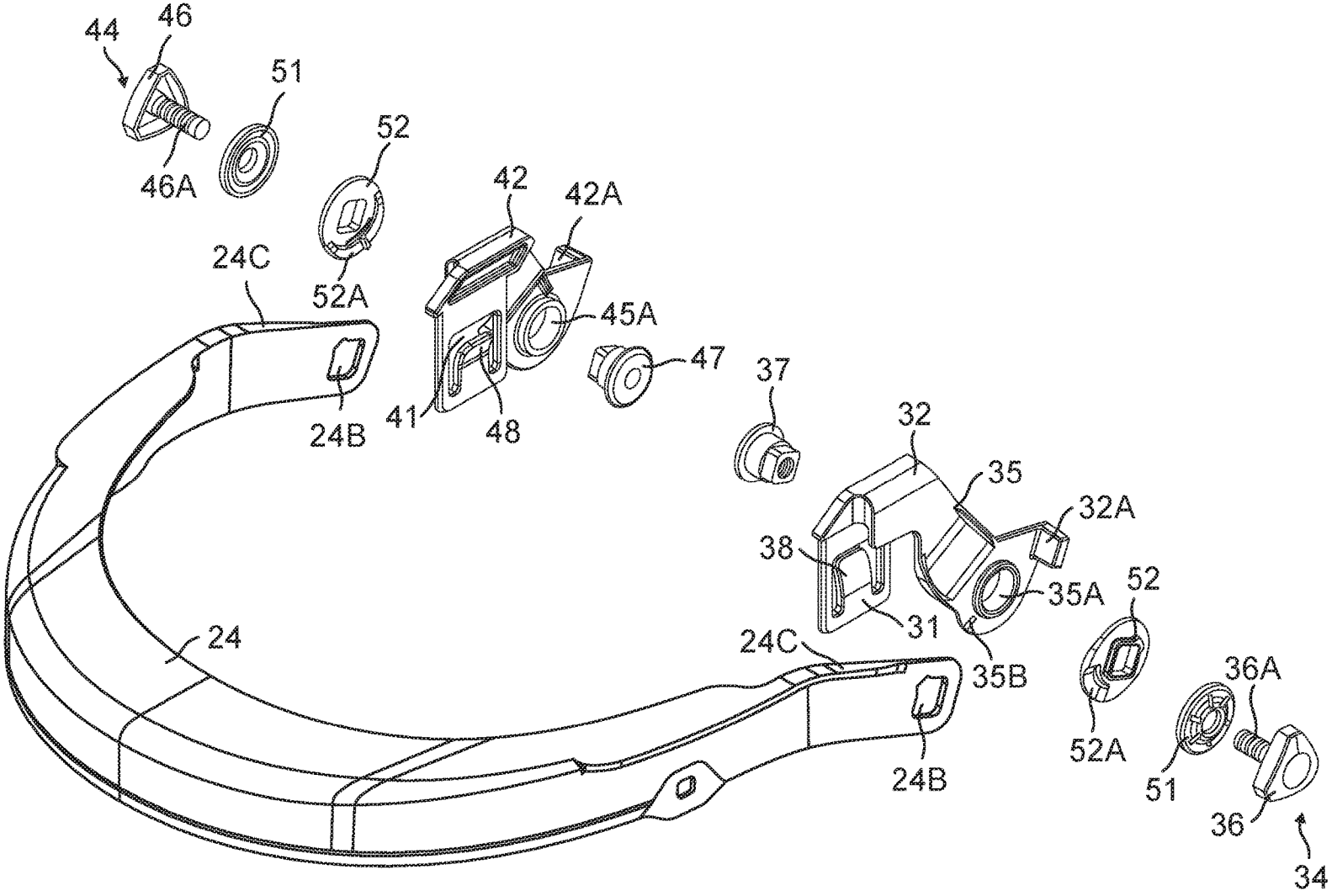
FIG. 8 is an exploded perspective view of the structure of FIG. 5, showing the mechanism for coupling the cap bracket to the helmet.
Figure 9:
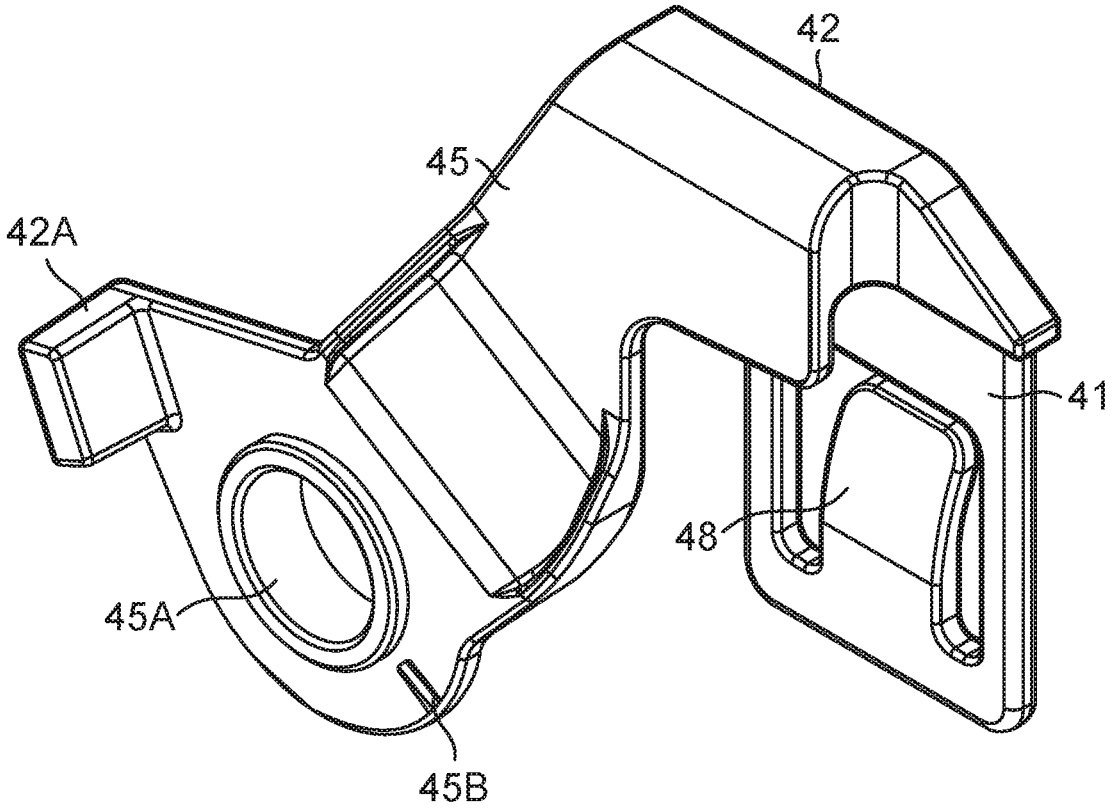
FIG. 9 is an enlarged perspective view of the right temple adapter of FIG. 8.
Figure 10:
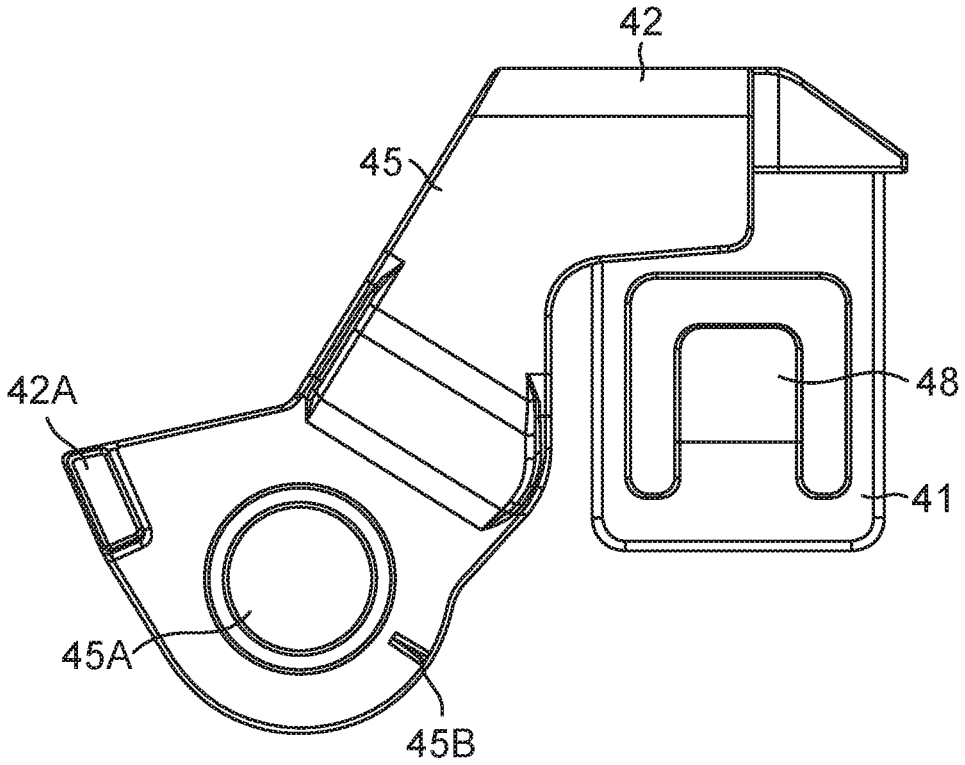
FIG. 10 is a side view of the adapter of FIG. 9.
Figure 11:
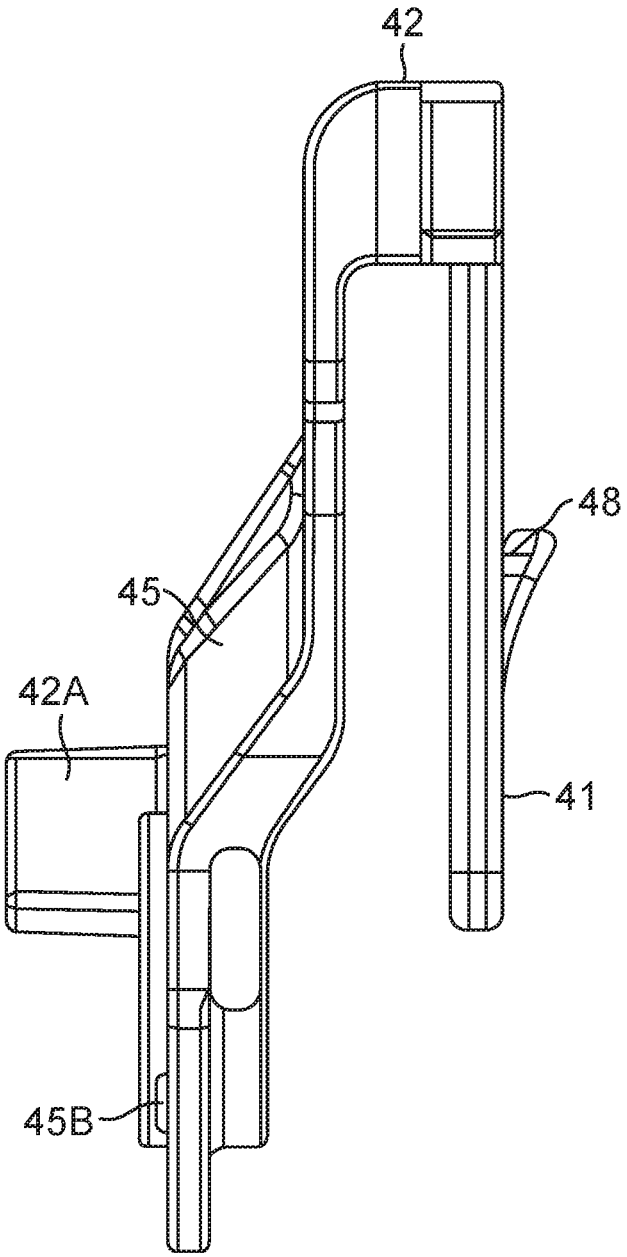
FIG. 11 is an edge view of the adapter of FIG. 9.

Helmet 22, as shown, is an example only. There are a variety of overall helmet shapes, and most have a short front brim 25 and a through pocket or slot 26 on each side. The pocket is configured to receive releasable tab 41 (FIGS. 8-10) of adapter 42. Cap bracket 24 is arcuately elongated and is pivotably mounted to adapter 42 at pivot 44. Adapter 42 and related structures are on the right side of the helmet. Left side adapter 32 is essentially a mirror image of adapter 42. As is clear from the drawing, arcuate cap bracket is pivotably mounted to either side of the helmet.

To simplify this description, only adapter 42 and its related structure will generally be described in detail, it being understood that adapter 32 and its related structure is effectively being described at the same time. At times both sets of numerals may be used.

Figure 3:
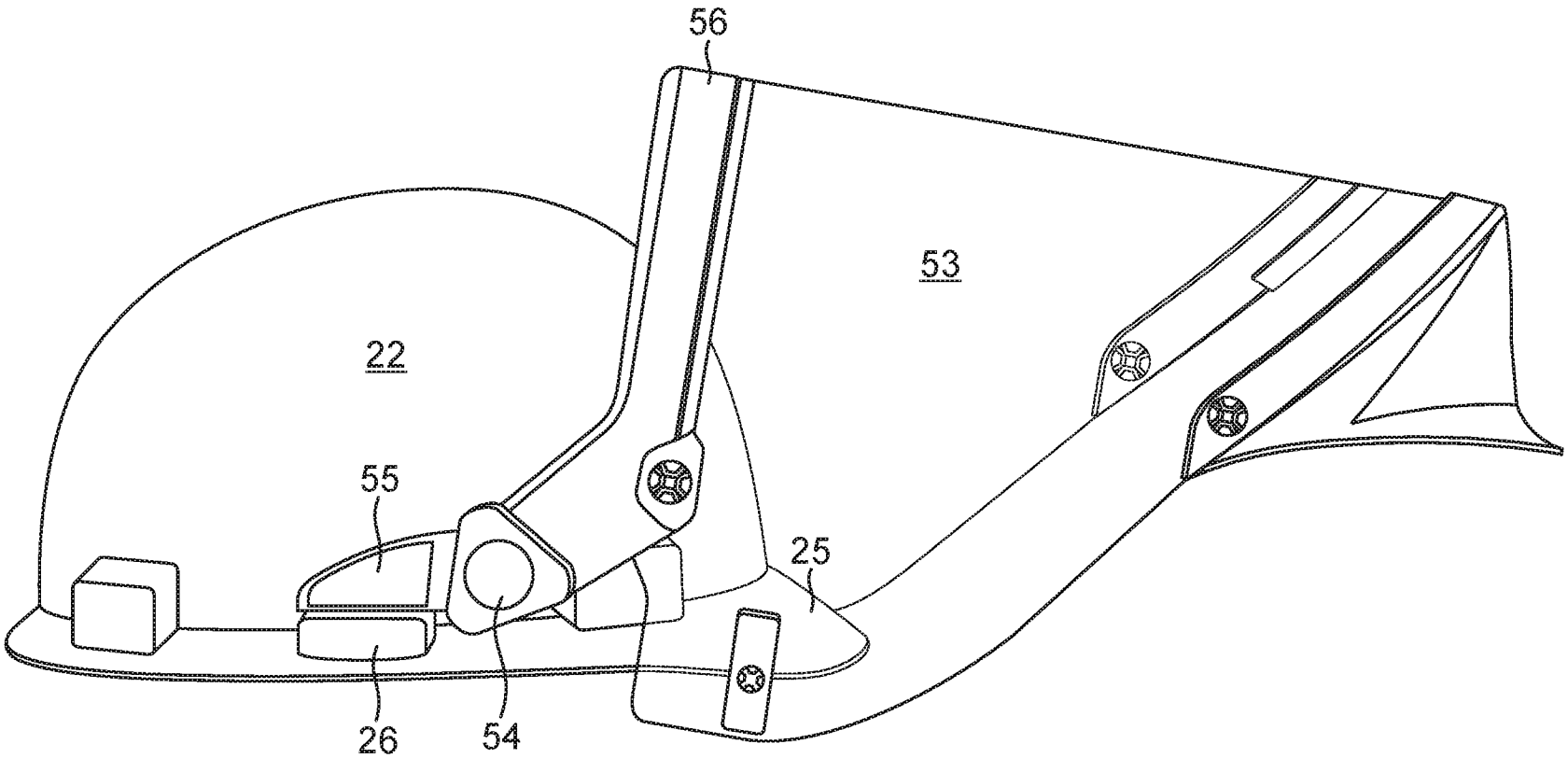
FIG. 3 (PRIOR ART)
FIG. 3 is a side view of a prior art structure with the face shield in stowed position.
Figure 4:
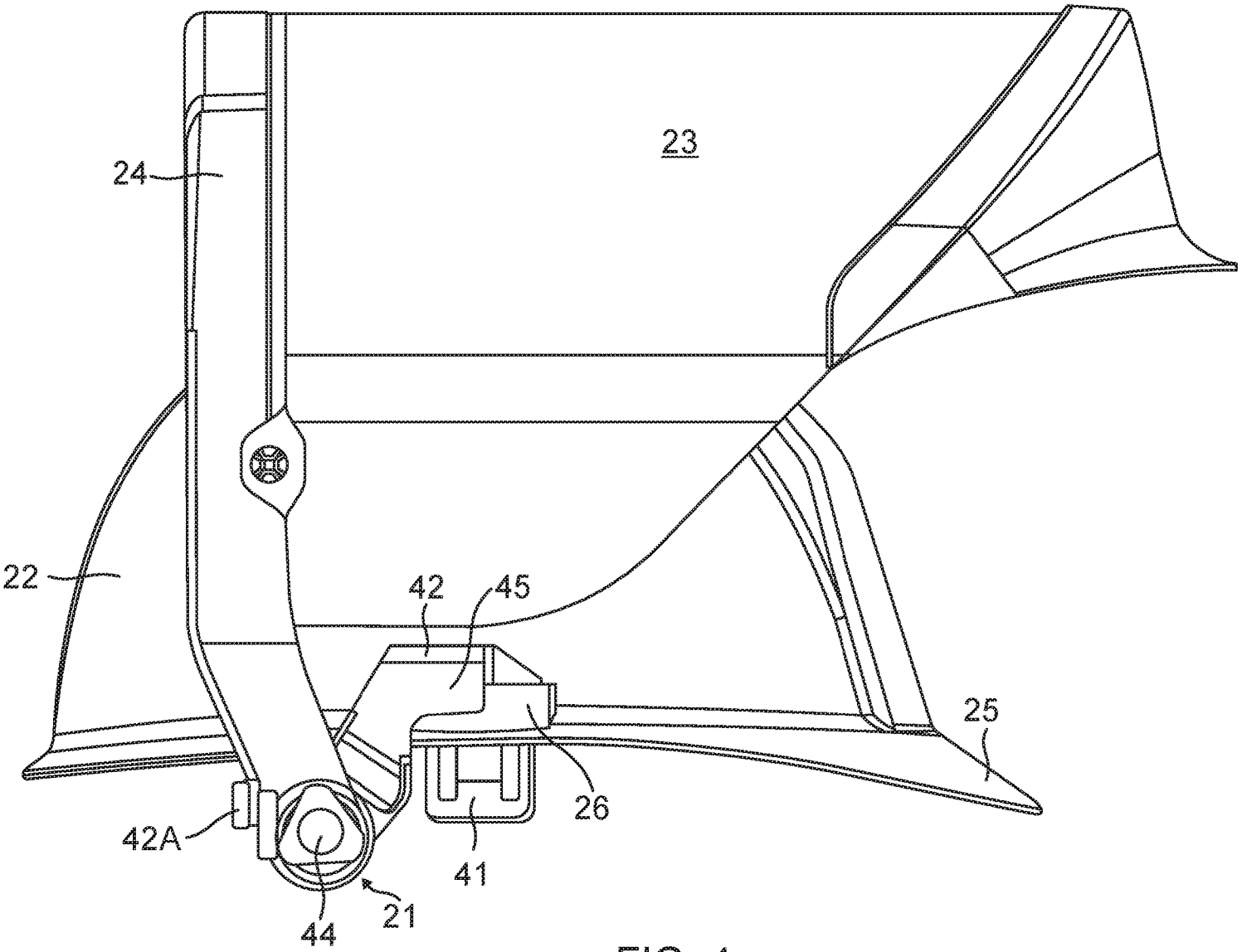
FIG. 4 is a side view if an embodiment of the invention similar to FIG. 2, with the protective face shield in the stowed position.
Figure 5:
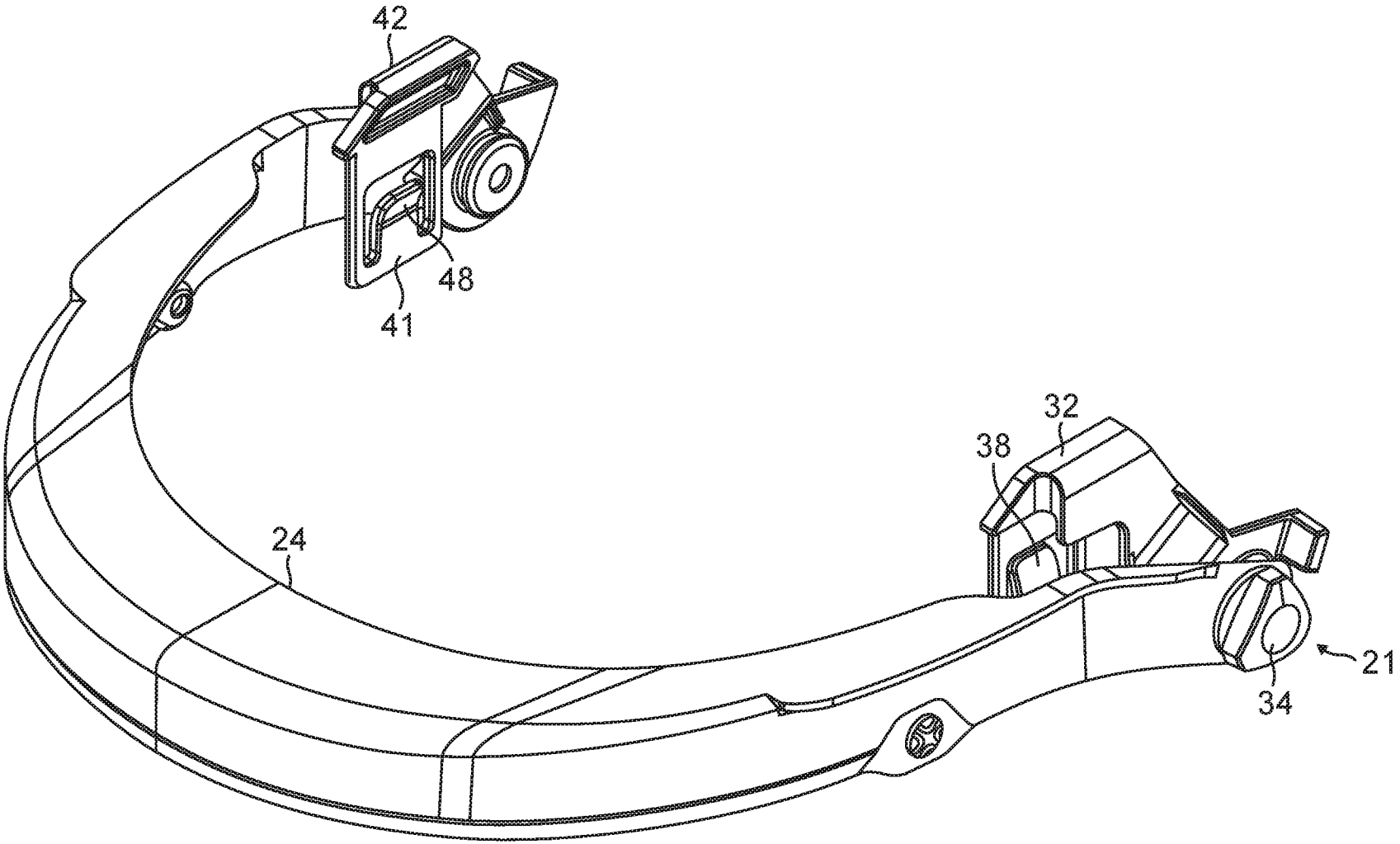
FIG. 5 is a perspective view of the weight compensating bracket and the cap bracket of FIGS. 1 and 2.
Figure 6:
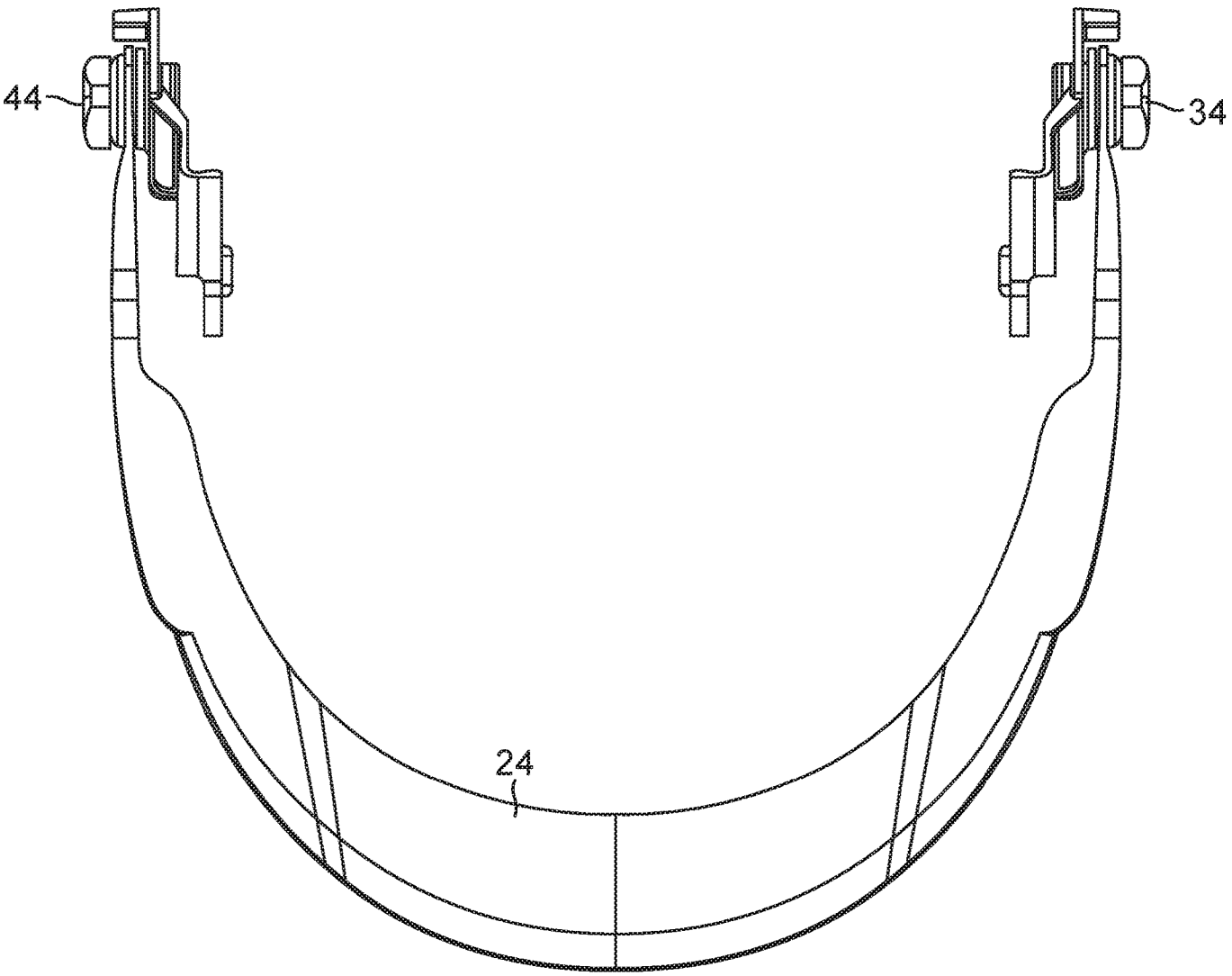
FIG. 6 is a top view of the structure of FIG. 5.

With adapters 32, 42 removably coupled to pockets 26 of the helmet, and arms 35, 45 sloping downwardly and rearwardly so that cap bracket pivots 34, 44 are located below and rearwardly from tabs 31, 41, face shield 23 is well balanced when in the stowed position, as shown in FIG. 4. By contrast, the face shield may project forward of the helmet brim by only about 1.5 inches, while it projects as much as 8 inches as shown in the prior art FIG. 3.

An example of the prior art is shown in FIG. 3. As before, helmet 22 has front brim 25 and slot or pocket 26 on either side. In this figure, face shield 53 is mounted to cap bracket 56. The cap bracket is pivoted to connector 55 which is coupled to the helmet at slot 26. The coupling pivot is 54. This shows how a typical prior art device pivots to the stowed position and the resulting front projection of the face shield beyond the helmet and the user's head.

Figure 7:
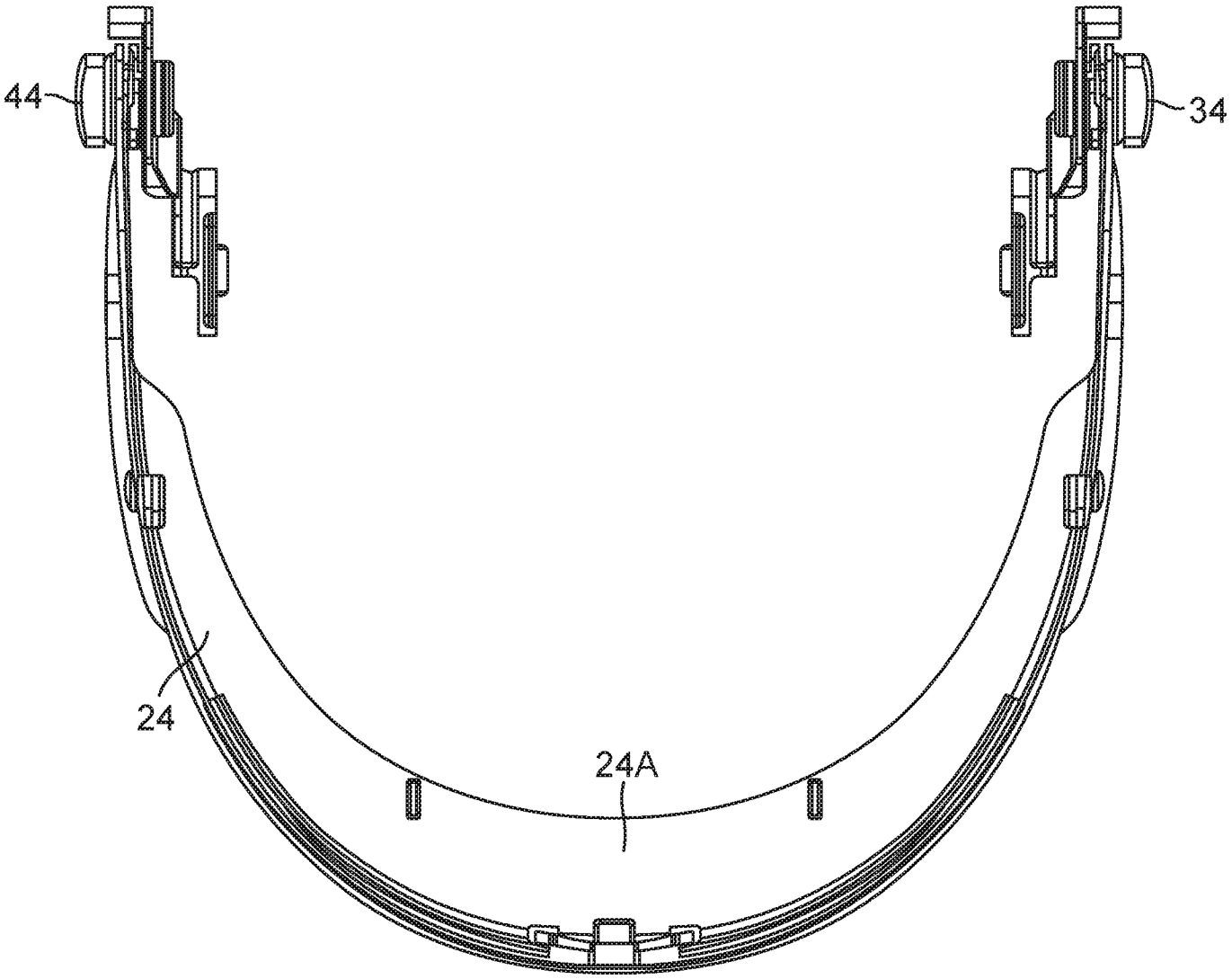
FIG. 7 is a bottom view of the structure of FIG. 5.

With particular reference to FIGS. 1 and 4, face shield 23 is secured to cap bracket 24, which is pivotally mounted to helmet 22 through adapter 42. Pivot 44 is positioned below and behind (with respect to helmet brim 25) the connection of adapter 42 to pocket 26 of the helmet. The distance from pivot 44 to the inside front (24A, as shown in FIG. 7) of cap bracket 24 is such that the cap bracket extends forward only sufficiently to engage cap brim 25 so that face shield 23 is substantially vertical in front of the user's face when in the deployed position (see FIGS. 1 and 2). Further, this combination of cap bracket and pivot enables the face shield to reside in a substantially horizontal orientation when in the stowed position as shown in FIG. 4. In the stowed position the face shield is above and clear of the top of the helmet, in a generally balanced arrangement, that is, it is somewhat weight balanced. When inside front 24A of the cap bracket is configured to rest on helmet brim 25 with the face shield is in the deployed position, the cap bracket and the face shield will clear the top of most helmets when moved to the stowed position (FIG. 4).

As an example, cap bracket 24 has a length from pivot 34, 44 to the inside surface 24A of the front (FIG. 1) of the cap bracket to enable the cap bracket to engage helmet brim 25 when the face shield is in the deployed position. As most helmets are designed, the distance from pivot 34, 44 to the helmet crown is shorter than the distance from the pivot to the helmet brim. So when in the stowed position the face shield is well clear of the top of the helmet, and in relative balance, as shown in FIG. 4.

Of course, there are different size helmets which could require some modifications to the dimensions of the cap bracket but the relationships described above generally apply.

In order to achieve the relationships of the face shield, cap bracket, and helmet, as shown in FIGS. 1 and 4, adapter 42 is formed with adapter hole 45A (FIGS. 8-11) about 1.60 inches below the top of helmet pocket 26 (FIG. 4), and about 1.73 inches behind the vertical centerline of pocket 26. Again, these are specific examples only. As stated above, the distance from opening 24B at the end of cap bracket 24, which is centered on pivot 44, to inside front 24A of the cap bracket, is configured to engage the helmet brim 25 by the inside front of the cap bracket when the face shield is in the deployed position and will clear the top of the helmet when pivoted to the stowed position.

These relationships ensure that the cap bracket/face shield combination resides in the stowed position shown in FIG. 4, clear of the helmet while being pivotably coupled to the helmet, and is pivotable to the deployed position of FIG. 1.

Note that the right side of the apparatus is shown in enlarged detail in FIGS. 8-11 and is a mirror image of adapter 32, shown in FIGS. 1, 2, and 4.

With continued respect to FIGS. 8-11, the cap bracket 24, adapters 32, 42, and the hardware by which they are pivotally connected, are shown in detail. Knob 46, having threaded stem 46A, is securely connected through cap bracket openings 24B and adapter hole 45A to threaded button 47, which secures all the bracket and cap bracket elements together in a pivotable manner.

The tension, or resistance, or drag on the pivot mechanism is adjustable. The threaded stem 46A of knob 46 extends through external spacer washer 51, through friction disc 52, through opening 24B in cap bracket 24, and through adapter hole 45A, and then engages threaded nut 47 and in some embodiment, threaded nut 37. The drag can be adjusted by turning knob 46, thereby changing the pressure of surface 52A on friction disc 52 as it engages rib 35B, 45B. The result is the face shield can be pivoted from the stowed position to the deployed position by a quick nod of the head by the user. Similarly, the face shield can be moved to the stowed position by one hand by the user because the cap bracket and the face shield are a relatively rigid combination structure, with each end simply pivoted as described. If desired, the user can tighten knob 46 to strongly hold the face shield in either end position.

Adapter 42 is formed with stop block 42A. This prevents over rotation of the shield when pivoting to the stowed position. The top edges 24C of cap bracket 24 make contact with stop blocks 32A, 42A when the cap backet and the face shield reach the position shown in FIG. 4.

A particular feature of adapters 32, 42, are engage and release tabs 31 and 41, formed with pawls 38, 48. When adapter 42 is mounted to the helmet, tab 41 is inserted into pocket 26. Tab 31 extends through the pocket and the curved end (pawl) 48 of the tab pops out to engage the bottom of the open-ended pocket. This prevents adapter 42 from being unintentionally dislodged from the helmet. To remove the face shield and bracket from the helmet, the cantilevered pawl end 48 of tab 41 is pushed to disengage from the bottom of helmet pocket 26, and tab 41 is easily slid upwardly, removing the bracket and face mask from the helmet.

Of course, there may be several reasons for disengaging a face shield from a helmet. One is if any part of the whole assembly becomes damaged. Another is if there are special or variations of the characteristics of the face shield required for a particular job. Another is for the user to be able to use the helmet without the face shield where a face shield is not called for.

There are several practical, in use, benefits provided by this structure, as disclosed. One is that the pivot mechanism is non-complex. This simplicity facilitates pivoting the shield between the two operative positions. It enables such pivoting, either way, with one hand. Very often a user has only one free hand available to move the shield. The pivot is all but immune to movement hinderance caused by ice buildup or caused by fouling by sand or other debris. There are no springs or metal parts, and the structure is dielectric. There are no exterior or projecting parts to creating a catching hazard with respect to external elements, such as tree branches, edges of structures, poles, or wires, for example.

The cap adapter pawl locks into the helmet receiving slot and cannot be accidentally dislodged, all the while being very simple and easy to disengage from the helmet. By depressing the pawl, the adapter is easily removed from the helmet slot.

Since a face shield, in normal use, is in the stowed position much more time than it is deployed, this structure is quite comfortable since it is somewhat weight centered when in the stowed position. Also, because of the cap bracket and adapter structure, and the pivot position with respect to the helmet receiving slot, when stowed the face shield overhangs the front of the helmet very little, making it less likely that the user will bump into things forward and above his eyes. In this case, as stated before, "very little" can be about 1.5 inches, compared with a typical prior art face shield/helmet combination of about 8 inches front overhang.

What is claimed is:

1. A weight compensating bracket for a combination of a protective face shield and a helmet, the helmet having a front brim and open-ended pockets on opposite sides, the bracket comprising:

a cap bracket to which the face shield is mounted, the cap bracket being arcuately elongated and having spaced ends configured to reside on opposite sides of the helmet and to selectively engage the front brim of the helmet; and pivoting apparatus at each end of the cap bracket which pivotably couples the cap bracket to the helmet, each pivoting apparatus comprising:

adapters which are removably mountable to the helmet, each adapter being configured with;

an arm; and a tab which is removably mountable to the pockets of the helmet, the tab extending downwardly from the arm, the arm extending downwardly and rearwardly with respect to the tab and external to the helmet as the tab engages the pocket of the helmet when the face shield is in a deployed position, the arm having a hole therethrough at the low, rear extremity which is configured to align with an opening in each end of the cap bracket, and a knob extending through the aligned opening in the cap bracket and the hole in the adapter;

whereby the face shield can be moved between a deployed position in front of the user's face and a stowed position above the helmet.

2. The weight compensating bracket according to claim 1, wherein the adapter tab is formed with a pawl which engages the bottom of the helmet pocket when the tab is inserted into the pocket and which can be pushed away from the pocket to disengage the adapter from the helmet, enabling the cap bracket, face shield, and adapter to be removed from the helmet.

3. The weight compensating bracket according to claim 1, wherein the knob having a threaded stem, wherein the stem extends through the hole in the cap bracket and engages a threaded nut to couple the cap bracket to the adapter in a pivotable manner.

4. The weight compensating bracket according to claim 3, wherein the knob coupled to a bearing disc configured to frictionally engage the adapter, thereby adjustably connecting the cap bracket to the adapter in response to tightening or loosening the knob.

5. The weight compensating bracket according to claim 1, wherein the adapter further comprises a stop block at the lower end of the arm which prevents the cap bracket and face shield from going past a predetermined position when rotated to the stowed position.

6. The weight compensating bracket according to claim 1, wherein the pivoting apparatus to which the cap bracket is pivotably connected is positioned on the helmet to engage the helmet brim when the face shield is rotated to the deployed position and is positioned to clear the helmet when the face shield is rotated to the stowed position.

7. The weight compensating bracket according to claim 1, wherein the cap bracket has a length, the length of the cap bracket in relation to the position of the holes in the arms which coincide with the openings in the respective ends of the cap bracket provide that the cap bracket engages the helmet brim when the face shield is in the deployed position and is clear of the helmet when the face shield is not rotated to the stowed position.

8. A weight compensating bracket for a combination of a protective face shield and a helmet, the helmet having a front brim and open-ended pockets on opposite sides, the bracket comprising:

a cap bracket to which the face shield is mounted, the cap bracket being arcuately elongated and having spaced ends configured to reside on opposite sides of the helmet and to selectively engage the front brim of the helmet; and pivoting apparatus on either side of the helmet which pivotably couples the cap bracket to the helmet, the pivoting apparatus comprising:

adapters removably mountable to each side of the helmet, each adapter being configured with;

a tab removably mountable to the helmet; and an arm connected to the tab and in spaced parallel relationship with the tab, the arm having a hole therethrough which is below and rearward of the tab when the face shield is in a stowed position, the cap bracket having openings at the ends thereof which are aligned with the holes in the arms and are pivotably connected;

whereby the face shield can be moved between a deployed position in front of the user's face and the stowed position above the helmet.

9. The weight compensating bracket according to claim 8, wherein the pivoting apparatus to which the cap bracket is pivotably connected is positioned on the helmet to engage the helmet brim when the face shield is rotated to the deployed position and is positioned to clear the helmet when the face shield is rotated to the stowed position.

10. The weight compensating bracket according to claim 8, wherein the cap bracket has a length, the length of the cap bracket in relation to the position of the holes in the arms which coincide with the openings in the respective ends of the cap bracket provide that the cap bracket engages the helmet brim when the face shield is in the deployed position and is clear of the helmet when the face shield is not rotated to the stowed position.

11. The weight compensating bracket according to claim 8, wherein the adapter tab is formed with a pawl which engages the bottom of the helmet pocket when the tab is inserted into the pocket and which can be pushed away from the pocket to disengage the adapter from the helmet, enabling the cap bracket, face shield, and adapter to be removed from the helmet.

12. The weight compensating bracket according to claim 8, wherein the knob having a threaded stem, wherein the stem extends through the hole in the cap bracket and engages a threaded nut to couple the cap bracket to the adapter in a pivotable manner.

13. The weight compensating bracket according to claim 12, wherein the knob is coupled to a bearing disc configured to frictionally engage the adapter, thereby adjust-ably connecting the cap bracket to the adapter in response to tightening or loosening the knob.

14. The weight compensating bracket according to claim 8, wherein the adapter further comprises a stop block at the lower end of the arm which prevents the cap bracket and face shield from going past a predetermined position when rotated to the stowed position.

* * * * *